US005901860A

United States Patent [19]

Nowicki

[11] Patent Number: 5,901,860

[45] Date of Patent: May 11, 1999

[54] HAND HELD TRANSFER TOOL FOR STOCKING DISPLAY PEGS OR HOOKS

[76] Inventor: John V. Nowicki, 7042—44th St. N., Oakdale, Minn. 55128

[21] Appl. No.: 08/871,918

[22] Filed: Jun. 10, 1997

[51] Int. Cl.[6] ..... B42F 7/00

[52] U.S. Cl. ..... 211/59.1; 211/57.1

[58] Field of Search ..... 211/59.1, 57.1; 248/220.31, 220.41, 220.22, 221.4

[56] References Cited

U.S. PATENT DOCUMENTS

| | | | |
|---|---|---|---|
| 3,211,293 | 10/1965 | Tarnoff | 211/59.1 |
| 4,283,082 | 8/1981 | Tracy | 294/15 |
| 4,502,602 | 3/1985 | Swanson | 211/59.1 |
| 4,610,413 | 9/1986 | Pedersen | 248/220.41 X |
| 4,671,417 | 6/1987 | O'Brien | 211/59.1 |
| 4,783,033 | 11/1988 | Valiulis | 248/220.22 |
| 5,054,727 | 10/1991 | Campbell et al. | 211/59.1 X |
| 5,131,800 | 7/1992 | Akagawa | 414/416 |
| 5,139,298 | 8/1992 | Dowell | 294/145 |
| 5,423,653 | 6/1995 | Harper | 414/680 |
| 5,579,927 | 12/1996 | Thompson et al. | 211/59.1 |
| 5,624,040 | 4/1997 | Hono | 211/59.1 X |
| 5,632,387 | 5/1997 | Johnson | 211/59.1 |

*Primary Examiner*—Ramon O. Ramirez
*Attorney, Agent, or Firm*—Westman, Champlin & Kelly, P.A.

[57] ABSTRACT

A stocking rod for assisting in the stocking of peggable packages onto support pegs for display and sale supports a number of packages, and has a tip portion that can be stabilized against the support peg. When the tip portion of the rod is stabilized, the packages can be slid from the rod onto the peg for display. The rod can be straight or provided with an angled tip portion so that it can easily be aligned with a variety of peg configurations.

13 Claims, 5 Drawing Sheets

HAND HELD TRANSFER TOOL FOR STOCKING DISPLAY PEGS OR HOOKS

BACKGROUND OF THE INVENTION

The present invention relates to a tool to assist in the placement of peggable packaged items or products onto pegs or hooks for sales presentation and display.

At the present time, a large number of products are individually packed on backing sheets with a hole that will receive a peg or hook at one end. Display racks in various stores utilize pegs of different configurations to support these products, with several of the products supported on a single hook.

When cartoned for shipment by a manufacturer, the packages are generally in a carton with the packages nested so that the ends having the peg openings on the backing cards will be alternated in opposite directions, for example, up and down, in the carton, or the packages will be laid on their sides. The stocking is now done by individually taking the packages and loading them essentially one by one, on a peg or hook for display. This involves a constant up and down motion of the clerks as they remove the products from cartons. Also, there is time wasted in trying to hold several packages at once and consequently dropping some.

While many types of display hooks and pegs are known in the prior art, all of them are based upon a person stocking one item at a time without any use of tools. In order to efficiently stock display pegs with packaged products, the present invention is advanced for supporting several of the packages at one time after threading the tool through the support openings, and then resting the tool onto the peg so that the entire supply on the tool can be slid onto the peg without difficulty.

SUMMARY OF THE INVENTION

The present invention relates to a stocking tool formed as a stocking rod for placing packaged products onto support pegs or hooks. These products generally have a support panel with an opening that is intended to slip onto a display peg, and the stocking rod is inserted into the openings of a number of packaged products when they are stacked in a carton, or placed onto the stocking rod adjacent the carton, and then supporting the stocking rod on a peg so that the entire number of products on the rod can be slid onto the peg without individually placing them.

The stocking tool comprises an elongated small-diameter support rod of size to pass through the apertures or openings of backing sheets for packaged products such as blister packs or even products that have a support aperture or tab. The rod has a handle at one end and the remote end of the rod is configured to be supported on a display peg. Packages needed to fill the entire peg may be loaded on the stocking rod. When the rod is filled as desired, the end of the stocking rod opposite from the handle is supported on the desired peg, hook, arm or other product holder, and all of the packaged products on the stocking rod are slid onto the display peg. This decreases the numbers of times that a clerk has to bend and straighten for placing packaged products onto pegs, and makes the entire process very rapid.

Many of the display pegs used have double lengths with a price sign holder on one length, which interferes with manual package placement. Other pegs have flattened ends or bent end portions that make manual loading difficult. The present stocking tool makes the installation onto various types of support pegs for merchandise very easily done.

The stocking rods of the present tool have outer ends that are configured to permit placing the rod onto the end of the peg, arm or hook to be filled and rested in place so that there is no substantial likelihood of it slipping off during the transfer of packaged products from the stocking rod onto the peg or hook.

Further, the task of rotating old stock is greatly simplified with the present invention because the stocking rod can be first supported on a peg that includes unsold stock that is on display. The existing stock can be slid onto the rod, and new stock added to the outer end of the rod, while leaving the older items adjacent the handle end, and then the entire stock placed back on the peg. The combination of old and new items is then transferred all at one time, leaving the newest items on the back of the peg and the oldest in the front.

The present device aids in stocking items by reducing labor, saving time, and reducing repetitive motion tasks, which are recognized problems in retail sales. The tool improves efficiency and saves time and money for the retailer.

DETAILED DESCRIPTION OF THE PREFERRED EMBODIMENTS

A stocking rod or package fill rod for use in adding peg-supported packaged products onto a support display peg made according to a first form of the present invention is shown at 10. The stocking rod has a straight shank 11 that has sufficient rigidity and length to support a number of the individual packages to be stocked. In this form of the invention the stocking rod has a remote or outer tip portion 12 that is bent at a desired angle relative to the longitudinal axis of the shank 11. A hand grip or handle 14 is provided at the opposite end from the angle tip portion 12.

The tip portion 12 is placed at an angle to make it easier to support the tip or outer end onto a product display peg.

Figure 2:
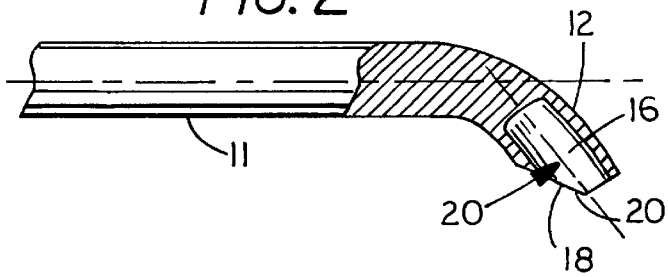
FIG. 2 is a fragmentary enlarged end view of one end of the stocking rod of FIG. 1 with parts broken away.
Figure 3:
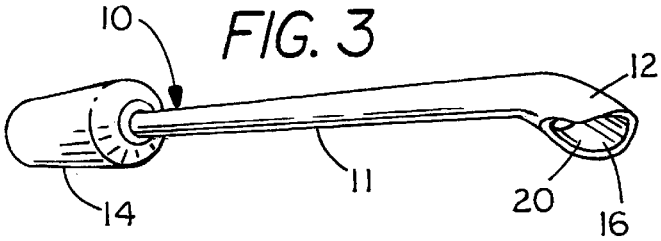
FIG. 3 is a perspective view of the stocking rod of FIG. 1.

As shown in FIG. 2, the tip portion 12 not only is formed so that the axis of the tip is at a desired acute angle relative to the axis of the shank 11, but the top has a bore 16 that is made to receive and be stabilized on ordinary size package support pegs. In addition, the edge of the outer tip is recessed as shown at 18 by cutting an angle to provide an entrance aperture 20, perhaps shown best in FIG. 3. The aperture receives an end portion of a peg for steadying the tip when it is being used in relation to a peg. The use of the fill rod or stocking rod will be discussed in connection with other figures where it is shown in working positions.

Figure 1:
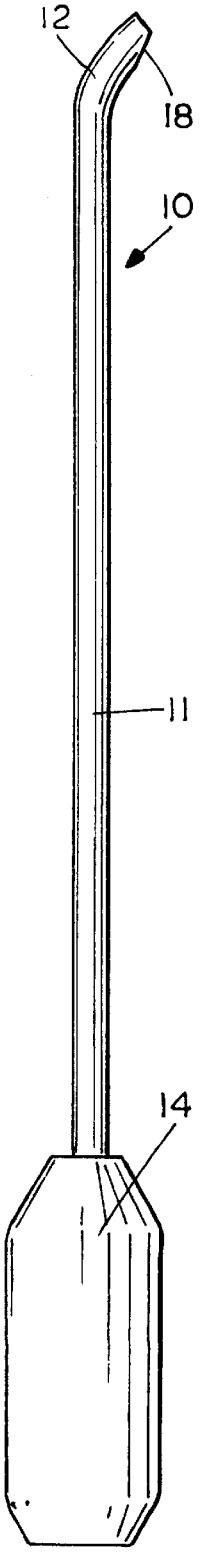
FIG. 1 is a side elevational view of a stocking tool comprising a rod made according to a first form of the present invention.
Figure 4:
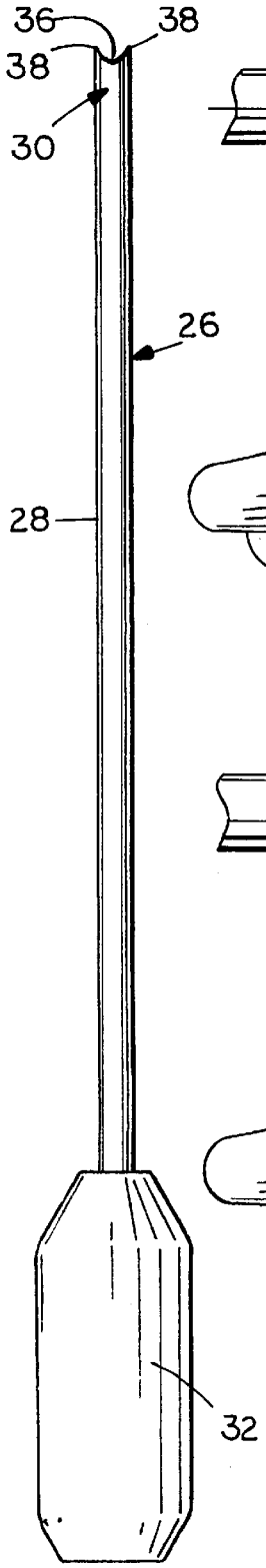
FIG. 4 is a side elevational view of a stocking rod made according to a second form of the invention.

A stocking rod according to the second form of the invention is illustrated generally at 26 in FIG. 4 and includes an elongated rod shank 28, again selected in length to hold a number of peg hung packaged products for installation on display pegs. The stocking rod 26 includes a tip portion 30 that is merely an extension of the straight shank 28 but is modified to provide a formed steady rest receptacle 36 for receiving portions of a peg to be filled. A handle 32 is at the opposite end of the fill rod from the tip portion 30.

Figure 5:
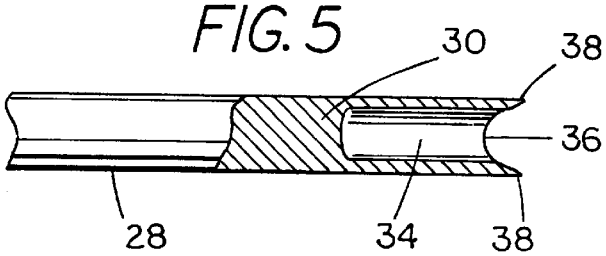
FIG. 5 is an enlarged fragmentary view of an outer end of the stocking rod of FIG. 4 with parts broken away.
Figure 6:
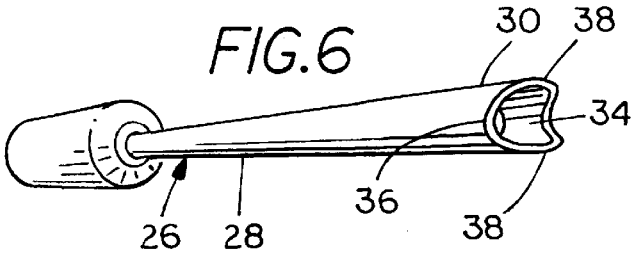
FIG. 6 is a perspective view of the stocking rod of FIG. 4.

The tip portion 30 is illustrated in FIG. 5, and it has an axial bore 34 and a formed cross bore or receptacle indicated at 36 that is formed by a part-cylindrical cross opening, which can be seen in FIG. 4 and also in FIG. 6. This cross opening receptacle 36 leaves support tips 38 on opposite sides of the opening and the bore 34 that will rest on display pegs to be filled with packages.

Figure 7:
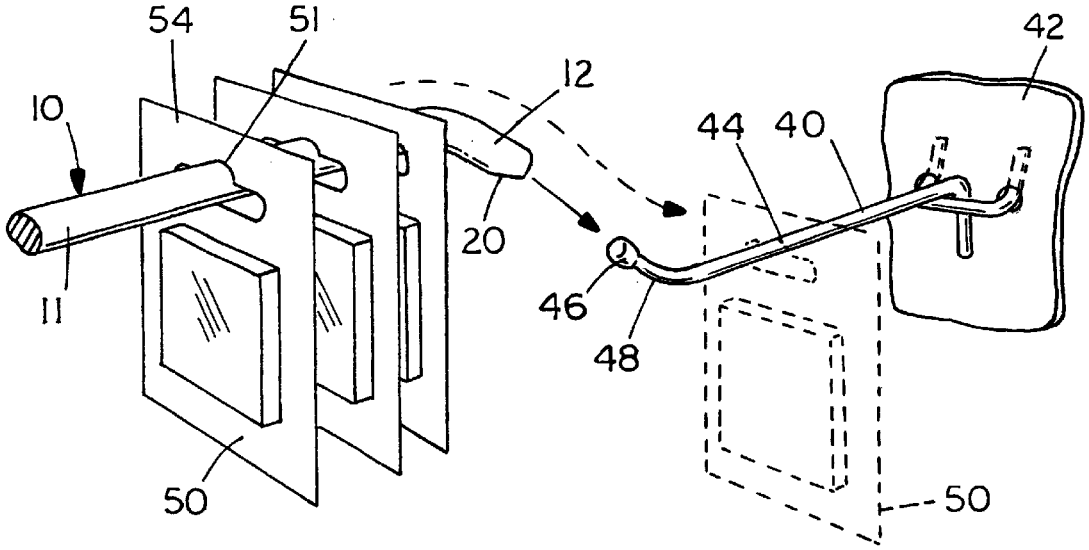
FIG. 7 is a view showing a stocking rod made according to the first form of the invention holding packages of products to be installed onto a support peg, just prior to placing the packages thereon.

FIG. 7 illustrates a stocking rod 10 in position to add packaged products onto a display peg 40. The term "peg" is used in a broad sense to include hooks or arms on which product packages can be supported. The display peg 40 is supported in a conventional manner on support board 42. The board 42 can be used with any of the display pegs illustrated merely by having suitable openings formed in the board for receiving the support ends of the display pegs. The display peg 40 includes an elongated product support and display shank 44. In this form, the display peg has an enlarged knob 46 at an outer end of an upturned section 48.

The stocking rod 10 has a number of individual product packages 50 supported thereon by extending the rod through apertures 52 in a backing card 54 of the packages 50. The product normally is retained on the backing card and may be overwrapped with suitable blister pack or the like. The aperture used, shown at 52, is shown to be typical of the apertures. Normally, various "delta" shaped holes will be used that will be adequately sized to slip over a support peg such as that shown at 40. The apertures will generally be shaped to have a centered guide recess or pocket to center the product package onto the stocking rod and on the support peg 40. Such a centered recess is illustrated at 51 and it fits over the shank 11 of the stocking or fill rod 10.

In this form of the invention, the tip portion 12 is positioned above the knob 46, and the angled portion 48 of the support peg 40. The tip portion 12 will fit over the knob 46. The aperture 20 formed by the cut 18 permits knob 46 to partially fit into the bore 16. It can be seen that once the stocking rod tip portion 12 is supported and stabilized on the knob 46 of the support peg 40, the packages 50 can easily be slid over the tip portion of the rod 10 and onto the shank 44 of the support peg 40. The angle of the tip portion 12 and the recess 20, or other support configuration of the rod that receives the outer end of the support peg are arranged so that a smooth transition is made for the packages and so they can easily be slid onto the support peg as shown by the dotted line representation of the packages 50 on the support peg.

Figure 13:
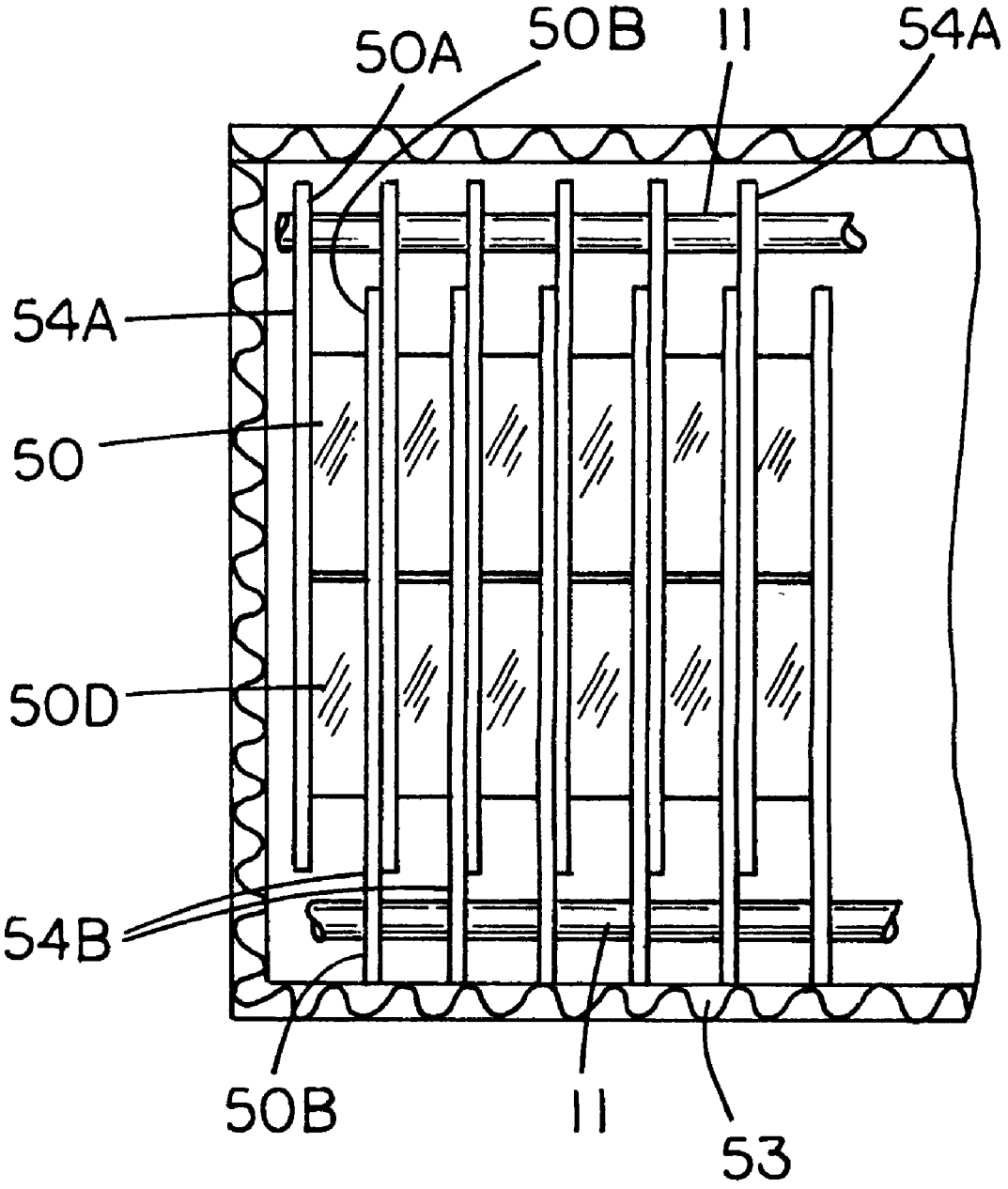
FIG. 13 is a representation of packages that are in an outer carton and are utilizing stocking rods of the present invention installed therein for ease of removal.

The stocking rod 10 can be loaded, as was explained, quite easily from a carton full of the individual packages, without repeated standing and bending over. If desired, the handle member 14 can be detachable or eliminated from shank 11 or 28 of the stocking rods 10 or 26 and the packages can be boxed or cartoned with the shank 11 or 28 in place through the apertures of all the products in one section of an outer carton as shown in FIG. 13.

Packages 50A include a backing card 54A and a blister pack 50B. Packages 50C include backing sheets 54B and a blister pack 50D, and with the packages alternating, the upper portions of the backing sheets 54A for the packages 50A and for the packages 50B are clear of the opposite ends of those backing sheets so that a shank 11 or 28 of the stocking rods 10 or 26 can be passed through apertures in the upper ends of the backing cards 54A and 54B, respectively and then placed into an outer carton 53.

It can be seen that one of the shanks 11 for example can be lifted out of a carton, through an open top, and the blister packs SOC which are attached to the backing cards 54A will be pulled out of the carton leaving the blister packs 50D attached to the backing cards 54B in place. Then the entire stock of packages (only a partial section of a carton is shown) can be placed onto one or more display pegs as desired. Then the second shank 11, loaded with packages, can be pulled out of the carton. The cartons also do not have to be oriented so that the backing cards are vertical, but they could be horizontal and pulled out. The cards likewise can be positioned in only one direction.

The handle such as that at 14 or 32 can be placed onto the shanks 11, or 28 as desired to form stocking rods 10 or 26. The stocking of the packages onto display pegs can take place in a normal manner. This cartoning will work with any other of the types of packages that are subsequently described. The cards 54A and 54B can be trimmed to desired lengths. The blister packs will rest one on another for support in the carton, so that the cards will not fall out of place.

When the shank 11 or 28 is lifted and all of the packages supported on one shank come out of the carton, and all slid onto a support peg. Of course, more than one peg can be filled with one load of products on the stocking tool if desired. A suitable stop could be provided at the end of the shank 11 or 28 as well, so the packages would not slip off the shank.

Figure 8:
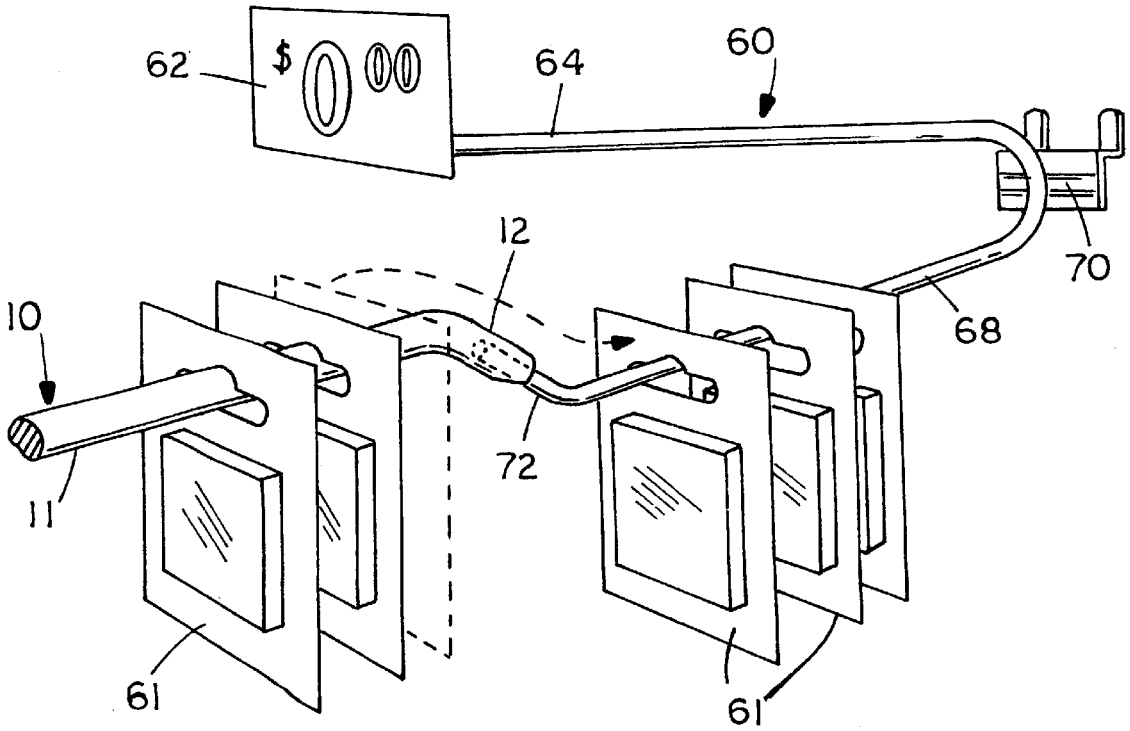
FIG. 8 is a perspective view of a different type of support peg showing a stocking rod of the form shown in FIG. 1 in place on the support peg and illustrating how packages are transferred to the support peg.

A modified support peg is shown at 60 in FIG. 8. This peg is U-shaped and has a price card support 62 at the outer end of an upper length 64 of the peg. The packages shown at 61 will be supported on a lower peg shank 68 of the support peg. The support peg 60 is supported on a hanger 70 that attaches to a suitable support board, wall or rack.

In this form of the invention, the fill or stocking rod 10 has a number of packaged products 61 thereon. The tip portion 12 is supported over an upwardly bent tip portion 72 at the end of the package support shank 68 of the support peg. It can be seen that the angle tip portion 12 fits over this upwardly turned section 72 of the support peg. The bore 16 in tip portion 12 of the stocking rod is of size to receive the diameter of a standard peg so that the stocking rod is stably supported. Then the packages 61 can easily be slid off the shank 11 of the fill rod 10 and over the tip portion 12 onto the support peg shank 68.

It also can be seen that if the product packages 61 shown in FIG. 8 on the peg shank 68 are old stock, they can first be slid onto the stocking or fill rod 10 by pulling them off the support peg, over the tip portion 12 and onto the shank 11, before the new product packages are put onto the shank 11. Then, the new packages can be added to the outer end portions of shank 11 and the new packages will be slid to the back of the support peg. The old stock will then be at the outer end of the support peg and will be sold first.

Figure 9:
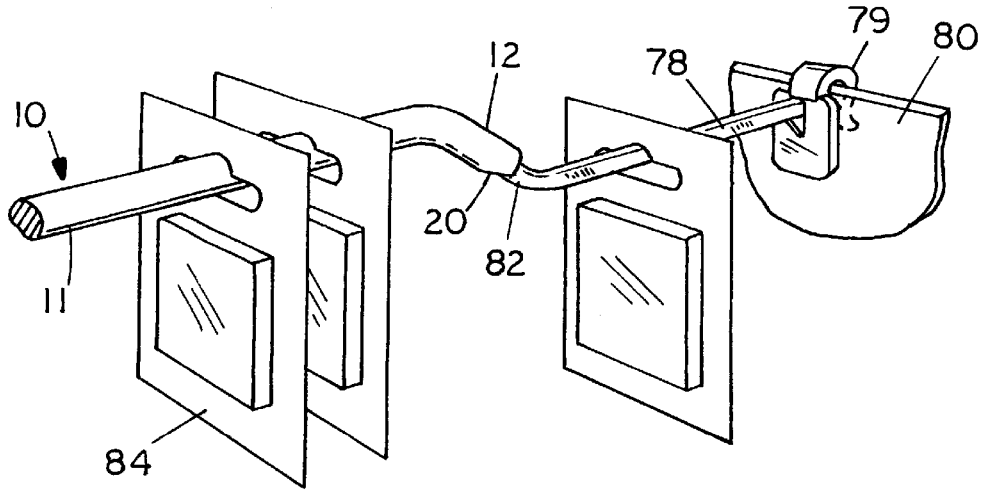
FIG. 9 is a perspective view of a modified peg showing the stocking rod of FIG. 1 installing packages thereon.

A further modified support peg 78 is illustrated in FIG. 9, and it can be attached with a clip 79 to the edge of a support board or display rack shown schematically at 80. This peg 78 has a square cross-section. It can be molded from plastic, whereas the first pegs use the round shanks can be made from a metal rod. In this form of the invention, the stocking rod 10 again has the tip portion 12 with the bore 16 receiving the upwardly inclined outer end 82 of the support peg 78. The packages shown at 84 can be slid on or off the peg 78 easily, over the tip portion 12.

Figure 10:
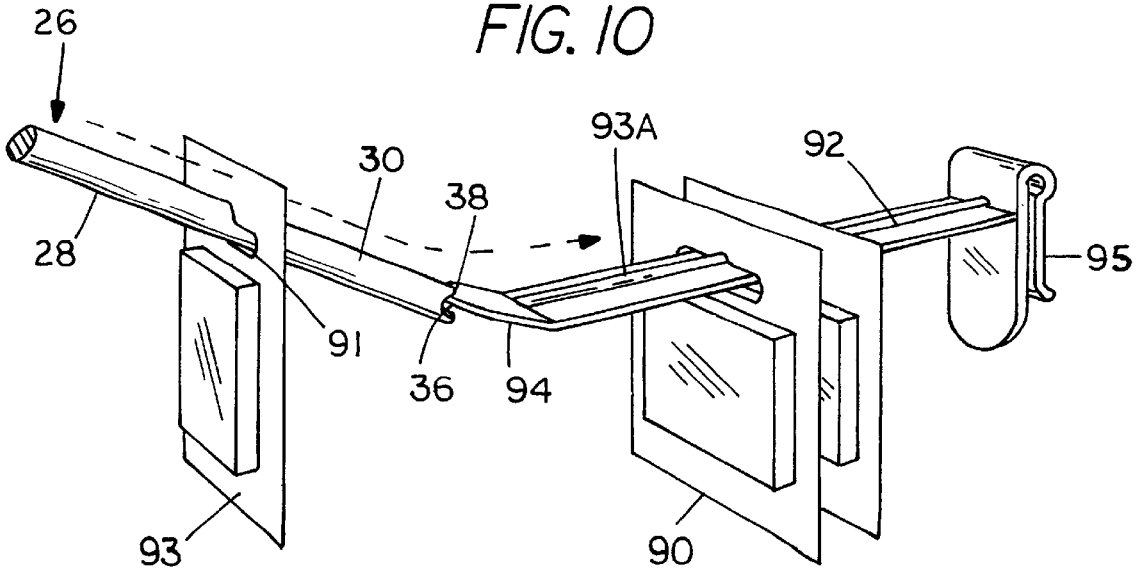
FIG. 10 is a perspective view of a modified type of support peg illustrating a stocking rod according to the modified form of the invention shown in FIG. 4 installing packages thereon.

FIG. 10 shows the second embodiment of the stocking or fill rod 26 being used for loading packages 90 onto a flattened or strap-like support peg 92 that also has a clip 95 that fits over an edge of a support panel. The support peg 92 has an upwardly bent tip 94 at its outer end, that is smooth, but it is quite wide and has a rounded outer edge. The stocking rod 26 is shown with shank 28 inclined upwardly so that the axis of the shank 28 is lying along the plane of the upwardly bent tip portion 94. The recess 36 at the outer end of tip portion 30 of the shank 28 is positioned so that the rounded end of the upwardly bent tip 94 slides into the recess 36. The shank 28 is thus supported on the upwardly bent tip 94 of the support peg 92 by the support tips 38 that are formed by the cross bore 36 on the shank 28.

In this form of the invention, again, packages can be filled onto the shank 28 of the stocking rod conveniently by sliding the shank through the provided apertures 91 in the backing sheets 93 of the product packages 90. The shape of the apertures 91 is such that it will be slid easily over the support peg 92 and the products will center on the longitudinal rib 93A provided on peg 92.

The use of the straight shank 28 on the stocking rod 26 permits easy sliding of the packages containing the products from the rod 26 over the stabilized tip portion 30 onto the peg 92. The tip portion 30 is stabilized by pressing the tip against the end of the support peg 92 when the end of the peg is received in the recess 36. The tip of the stocking rod 26 will not then wave or wiggle relative to the support peg 92.

Figure 11:
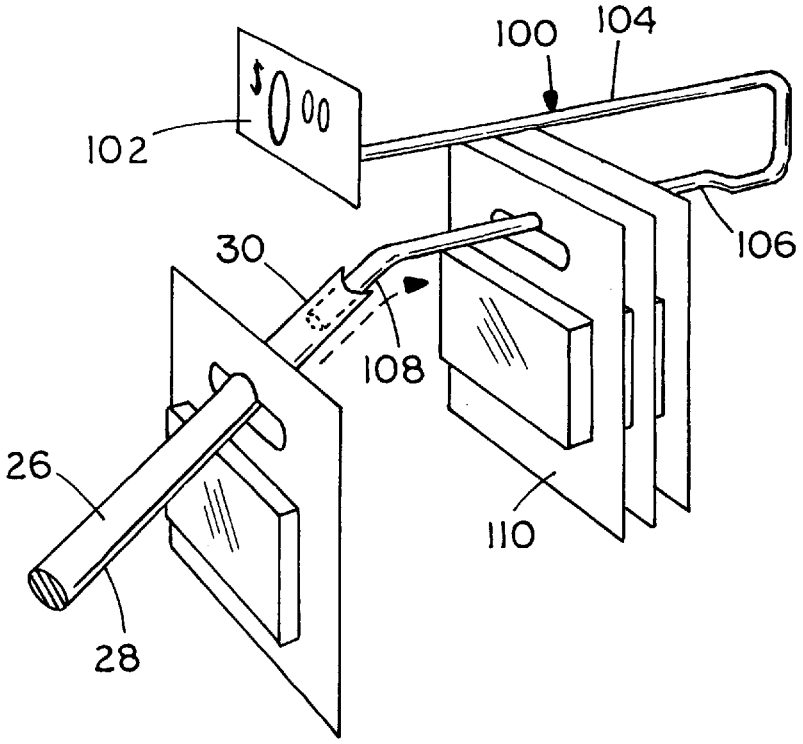
FIG. 11 is a perspective view of a different type of support peg showing the stocking rod of FIG. 4 in place for installing and adding packages to the support peg.

FIG. 11 shows a modified support peg 100 that also has a price tag panel 102 on an upper shank 104 of the peg. A lower shank 106 of the U-shaped support peg 100, as shown, has a downwardly inclined tip portion 108.

In many instances, it is difficult to individually fit packages between upper and lower shanks of a U-shaped support peg such as that shown in FIGS. 8 and 11, but the stocking rod permits the guiding of the packages shown at 110 onto the shank of a U-shaped support peg without difficulty. The stocking rods also can be used for slightly moving the shanks of the Ushaped support pegs apart for filling if needed for clearance. The tip portion 30 of the shank 28 of the stocking rod 26 in this form of the invention receives the tip portion 108 of the peg in the bore 34 that is shown in FIG. 5.

The straight shank 28 of the rod 26, with the straight tip portion 30, is easily adapted to this type of support peg because the axis of the shank 28 can be aligned with the axis of the tip portion 108 of the support peg, and the packages 110 can thus be easily transferred between the stocking rod shank 28 and the shank 106 of the support peg 100.

Again, the transfer of packages can be in either direction, that is, either onto or off of the stocking rod, so that the old stock can be removed before the new stock is placed onto the rod 26, or new stock can be added to existing packages that may be on the shank 106 of the support peg.

Figure 12:
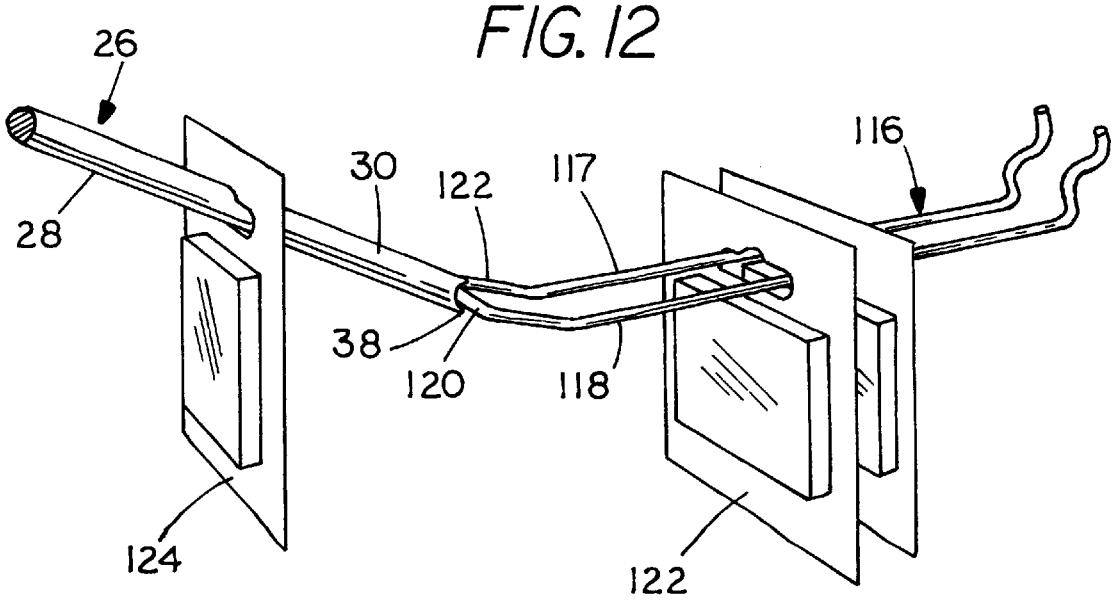
FIG. 12 is a perspective view of a still different form of a support peg for packaged products showing the stocking rod of FIG. 4 in place for adding packages onto the support peg.

In FIG. 12, a further modified support display peg 116 is illustrated. This is a U-shaped support peg that has a pair of parallel, horizontally aligned shanks 117 and 118 joined with a cross member 120 at the outer end. The shanks 117 and 118 are bent upwardly at a tip portion 122 so that the cross member 120 is upwardly spaced from the plane of the shanks 117 and 118. In this form of the support peg, the straight shank rod 26 is also used. It can be seen that the tip portion 30 of the stocking rod is easily guided onto the cross member 120, placing the cross member 120 in the cross bore 36. The tip portions 38 provide stability. In this form, the packages 124 can be slid from the shank 28 of the stocking rod 26 onto the peg 116 quite easily.

It is to be noted that the support pegs that are shown are all supported in a suitable manner onto a wall or panel, even though such walls and panels are not illustrated in all of the figures.

In construction and operation of the stocking rod, the rod generally is a standard diameter, and it can be a solid rod or a tube with the tips configured as shown herein. The stocking rods essentially need to accommodate the angled end portions of the support pegs. The junction of the stocking rod and the support peg must allow for a smooth transfer of the packages. An improper angle between the peg and the end of the stocking rod will cause the packages to tend to bind and catch as they are slid over the junction.

The stocking rod also must be strong enough to hold the products without bending extensively or breaking, but yet has to be capable of being bent and shaped into the needed configuration. In order to accommodate all forms of the pegs, a straight shank fill rod and a fill rod having an angled tip are desirable.

The present invention thus utilizes a temporary support stocking rod for holding packages that are peggable, meaning that they have an aperture for support on a support or display peg, and the permitting a smooth transfer of the items onto the pegs. While the stabilization generally is shown as a receptacle or other member for receiving an end portion of the peg, the stabilization function can be achieved in many different ways, even with very slight recesses or flanges.

In some instances it would be possible to have a straight rod that could be used for sliding the packages onto a peg without physical contact between the fill rod and the peg, with a steady hand holding the stocking rod aligned.

Where the support pegs have upper and lower shanks, the stocking rods can be used for loading one peg in direction to separate the shanks so that the packages can slide on easily. Also, a carton that can be set up to permit the support rod to slide through several packages before they are removed from the carton. The cartons can be broken open and if the products are interleaved so that the apertures of the package extend in one direction or the other and are aligned, a rod then can be slipped into the apertures for half the packages in the carton and another rod slipped into the apertures for the other half of the packages and the packages removed by pulling the rods. Also, the rods can be prepositioned in the apertures in the shipping carton, as the cartons of packages are loaded in the factory.

The term "package" is meant to include a product that has an aperture or hook portion to permit it to be supported on a peg, whether or not a separate backing card or outer package is used.

Although the present invention has been described with reference to preferred embodiments, workers skilled in the art will recognize that changes may be made in form and detail without departing from the spirit and scope of the invention.

What is claimed is:

1. A temporary support tool for peggable product packages that are to be displayed on a display peg, the temporary support tool comprising an elongated rod having a substantially uniform outer diameter, said rod being of size to temporarily receive the peggable product packages and having an end portion of the rod having the substantially uniform outer diameter and being alignable with an outer end of the display peg for sliding the packages from the rod onto the display peg, the support tool also comprising means for preventing the support tool from sliding past the outer end of the display peg, wherein said rod has a transverse recess that partially intersects an axial bore extending along a central axis of the end portion of the rod.

2. The tool of claim 1, wherein the end portion of the rod is configured to engage the outer end of the display peg for stabilizing the rod of the support tool relative to the display peg.

3. The tool of claim 2 and a handle member at an opposite end of the rod from the end portion.

4. The tool of claim 1, wherein said rod of the support tool is substantially straight throughout its length, including the end portion.

5. A temporary support tool for peggable product packages that are to be displaved on a dislay peg, the temporary support tool comprising an elongated rod having a substantially uniform outer diameter, said rod being of size to temporarily receive the peggable product packactes anid having an end portion of the rod having a substantially uniform outer diameter and being alienable with an outer end of the display peg for sliding the packages from the rod onto the display peg, wherein said rod of the support tool has a tip portion bent at an angle relative to a longitudinal axis of a major portion of the rod, said tip portion having a configuration thereon for engaging the display peg to be loaded with product packages supported on the rod.

6. The tool of claim 5, wherein the configuration comprises a recess adapted to receive a portion of the displav peg on which product packages supported on the rod are to be placed.

7. The tool of claim 6, wherein said recess comprises a bore extending inwardly from an end surface of the rod of the support tool.

8. The tool as specified in claim 6, wherein the recess extends transversely to a central axis of the tip portion of the rod to form a U-shape with a pair of projections formed by the U-shape for resting on the outer end of the display peg for stabilization.

9. A temporary support tool for peggable product packages that are to be displayed on a display peg, the temporary support tool comprising an elongated rod having a substantially uniform outer diameter, said rod being of size to temporarily receive the peggable product packages and having an end portion of the rod having the substantially uniform outer diameter and being alienable with an outer end of the display peg for sliding the packages from the rod onto the display peg, the support tool also comprising means for preventing the support tool from sliding past the outer end of the display Peg wherein said rod of the support tool is substantially straight throughout its length, and has an axial bore in the ent portion which opens to an outer end thereof and a cross bore intersecting said axial bore and forming at least one lip at the end portion that serves as a stabilizer for engaging the support peg.

10. A method of restocking peggable items onto a support peg, said items having an aperture for supporting on a peg, comprising the steps of:

supporting the peggable items temporarily on an elongated member having a substantially uniform transverse cross section;

passing the elongated member through the apertures of a plurality of the peggable items;

resting the elongated member onto an outer end of the peg and in alignment therewith such that the apertures of the items are aligned with the peg;

sliding the items supported on the elongated member across the tip portion and onto the peg; and wherein the resting step is performed prior to the sliding step.

11. The method of claim 10 including the step of stabilizing the elongated member by providing a receptacle on the tip portion of the elongated member and positioning the outer end of the peg in the receptacle.

12. The method of claim 10 including a restocking step of removing items on the peg and sliding such removed items away from the tip portion of the elongated member prior to the resting step, the resting step comprising placing new items between the items removed from the peg and the tip portion of the elongated member, prior to the recited step of resting the elongated member onto the outer end of the peg and sliding the items on the elongated member onto the peg.

13. The method of claim 10 including the step of having the peggable items on an elongated member in an outer carton, and removing the elongated member and the peggable items thereon prior to the placing step.

* * * * *

UNITED STATES PATENT AND TRADEMARK OFFICE

CERTIFICATE OF CORRECTION

PATENT NO. : 5,901,860
DATED : May 11, 1999
INVENTOR(S) : John V. Nowicki

It is certified that error appears in the above-identified patent and that said Letters Patent is hereby corrected as shown below:

Column 7, line 38, cancel "displaved" and insert --displayed--.

Column 7, line 41, cancel "packactes anid" and insert --packages and--.

Column 7, line 43, cancel "alienable" and insert --alignable--.

Column 8, line 12, cancel "alienable" and insert --alignable--.

Column 8, line 16, cancel "Peg" and insert --peg--.

Column 8, line 18, cancel "ent" and insert --end--.

Signed and Sealed this

Sixth Day of June, 2000

*Attest:*

*Attesting Officer*

Q. TODD DICKINSON

*Director of Patents and Trademarks*